United States Patent [19]

Molly

[11] 3,933,082

[45] Jan. 20, 1976

[54] AXIAL PISTON TYPE MACHINE

[76] Inventor: Hans Molly, Dr. Eugen-Essig-Str.48, 7502 Malsch/Krs. Karlsruhe, Germany

[22] Filed: Aug. 6, 1973

[21] Appl. No.: 385,838

[30] Foreign Application Priority Data

Aug. 16, 1972 Germany ..... 2240116
May 24, 1973 Germany ..... 2326435

[52] U.S. Cl. ..... 91/485; 91/488; 91/499
[51] Int. Cl.[2] ..... F01B 1/06
[58] Field of Search ..... 91/472, 490, 499, 506, 91/488

[56] References Cited

UNITED STATES PATENTS

| | | | |
|---|---|---|---|
| 2,280,875 | 4/1942 | Wahlmark | 91/506 |
| 2,360,025 | 10/1944 | Wahlmark | 91/480 |
| 2,721,519 | 10/1955 | Henrichsen | 91/472 |
| 3,066,613 | 12/1962 | Reinke | 91/485 |
| 3,090,361 | 5/1963 | Orshansky | 91/485 |
| 3,657,970 | 4/1972 | Kobayashi | 91/485 |
| 3,802,321 | 4/1974 | Bosch | 91/485 |

*Primary Examiner*—William L. Freeh
*Assistant Examiner*—Gregory LaPointe
*Attorney, Agent, or Firm*—Darbo, Robertson & Vandenburgh

[57] ABSTRACT

An axial piston machine has a cylinder barrel mounted on a shaft and rotatable with respect to a portion of the casing. Between the cylinder block and the casing portion is a disc. The side of the disc adjacent the casing portion is concave and abutting casing portion is correspondingly convex. The disc is restrained against rotation and forms part of the valving means for the cylinder barrel. In one embodiment the casing and shaft are in two articulated sections. The shaft sections lie in a common plane and are pivotable with respect to each other about a point and the casing sections are pivotable about an axis normal to that plane and offset with respect to the shaft pivot point. In another embodiment the casing and shaft are each a single unit.

5 Claims, 13 Drawing Figures

AXIAL PISTON TYPE MACHINE

BACKGROUND AND SUMMARY OF THE INVENTION

This invention relates to an axial piston type machine comprising a cylinder barrel mediately or immediately journaled in a casing portion or a part associated with the casing and mounted for axial movement therein. The cylinder barrel has axial cylinder bores. Axial pistons are mounted for sliding movement in the cylinder bores. Connecting passages extend from the cylinder bores and open at an end face of the cylinder barrel. There is a valving surface on the casing portion engaged by said end face of said cylinder barrel due to its axial movability. The valving surface has a pair of arcuate valving recesses adjacent the openings of said connecting passages. These valving recesses are connected to a high pressure connection and a low pressure connection, respectively. There is a stroke plate adjacent the opposite end face of said cylinder barrel. The axis of said stroke plate forms an angle with the axis of the cylinder barrel. The stroke plate is engaged by the axial pistons to produce a reciprocating movement of said axial pistons upon relative movement between cylinder barrel and stroke plate.

In one type of prior art axial piston type machine (which can be either a pump or a motor) the casing portion is a barrel support which is pivotable together with the cylinder barrel. The stroke disc is connected with a machine shaft, and the pistons are linked to the stroke disc. The piston rods are in positive articulated connection to the pistons at one end and to the stroke disc at the other end. The cylinder barrel is, in such arrangement, held centered to a fixed pivot point located on the shaft axis.

In prior art axial piston type machines of this kind, efforts have been made to make the pivot angle, through which the barrel support is pivotable relative to the machine axis, as large as possible, in order to minimize the dimensions of the machine having a given capacity. In prior art machines the centering of the cylinder barrel is achieved by using a concavespherical end face on the cylinder barrel in abutment with a convex-spherical surface of the barrel support. These also serve as the valving surface for connecting the cylinder bores alternatingly to high and low pressure. There are various problems:

With large pivot angles rather large centrifugal torques are exerted on the cylinder barrel due to the pistons extending more or less into the cylinder bore. On one side of the cylinder barrel the pistons extend only a short distance into the cylinder bore. On the opposite side the pistons extend deep into the cylinder bore. The centrifugal forces acting on the pistons radially outwards thus form a force couple having a level arm equal to the piston stroke. The larger the pivot angle that is used the greater this lever arm becomes. Thus the effective centrifugal torques are increased, and these torques can be substantial.

Further torques occur due to the fact that slideway forces are exerted by the oil pressure due to the piston rods not being parallel to the barrel axis. These slideway forces result in torques which act in the same sense as the centrifugal torques.

Furthermore inertial forces occur with quick changes of the pivot angle.

These torques and forces have to be taken up by the spherical valving surface, which results in problems.

In another type of axial piston type machine, the cylinder barrel is mounted for rotation in the casing, and the axial pistons slidingly engage a swash plate at one end of the cylinder barrel. The mounting of the cylinder barrel in the casing is usually effected by supporting the cylinder barrel on a shaft. The shaft is rotatably mounted in the casing and means are provided for preventing rotation of the cylinder barrel relative to the shaft. Usually, the axial pistons slidingly engage the swash plate through shoes which are articulated on the pistons by means of ball-and-socket joints.

In axial piston type machines of this kind, the hydraulic forces acting on the pistons are resolved in the plane defined by the centers of the ball-and-socket joints at which the shoes are articulated on the pistons. One force component acts at a right angle to the swash plate and is balanced by a balancing hydraulic pressure area provided below the shoe. Another force component acts in said plane. This latter force component has a radial and tangential component, these components, as acting on a selected piston, being variable during the rotation of the cylinder barrel. In the top and bottom dead center positions of the pistons (the "North" and "South" position), the tangential component becomes zero and the radial component is at a maximum. In the positions angularly spaced therefrom by 90° (the "East" and "West" positions), the radial component becomes zero and the tangential position is at a maximum. The tangential components of the hydraulic forces acting on the plane of the centers of the ball-and-socket joints produce a resultant torque, which becomes effective on the cylinder barrel through the pistons. This torque is produced when the axial piston type machine operates as a motor, i.e., if oil under pressure is supplied to the high pressure side of the machine, and must be exerted when the axial piston type machine operates as a pump in order to deliver oil at a selected pressure. The radial components of the hydraulic forces add up to a resultant radial force which acts on the center of the circle defined by the circular array of centers of the ball-and-socket joints.

In a prior art machine of this type, the cylinder barrel is rigidly supported on a shaft, which, in turn, is mounted for rotation in the casing, whereby this resultant radial force is taken up by the shaft and, through the shaft, by the casing. It is thereby necessary that the cylinder barrel have a fixed orientation in the casing. There is however the further requirement that the cylinder barrel sealingly engage a valve surface on the casing. This is necessary to connect the cylinder bores alternatingly to the high and low pressure side of the machine. These requirements cannot be met merely by high precision manufacturing, particularly since the shaft will deform due to the high hydraulic forces.

Therefore in prior art axial piston type machines the valving means for alternatingly connecting the cylinder bores to the high and low pressure sides of the machine used a disc or the like which is held in the casing for limited movement. This disc is pressed against the end face of the cylinder barrel by plungers or the like, which are exposed to high pressure or to low pressure, respectively. Thereby the disc aligns itself with the end face of the cylinder barrel. In this type of axial piston machine the valving surface is pressed against the cylinder barrel with insufficient balance of the hydraulic forces, because the pulsating force, which acts between valving means and cylinder barrel — with an odd number of cylinders — and which tends to separate these parts, must be balanced by a simply constant pressing force. And therefore no complete balancing is possible.

In still another axial piston type machine of this kind, the cylinder barrel is supported for pivotal and limited axial movement in the center of the circle defined by the circular array of centers of the ball-and-socket joints or where the shaft axis intersects the plane defined by this circular array. This can be done by means of spherical gear means. Thereby the support and the shaft take up the radial force described above, with no torques acting on the cylinder barrel. Thus the cylinder barrel is free to align itself with the valving surface of said valving means.

This design, too, suffers from certain disadvantages: Besides the radial forces resulting from the described resolution of hydraulic forces there are other forces acting on the cylinder barrel, for example, forces due to friction or centrifugal forces. These other forces, which, in practice, are not at all negligible produce tilting torques on the cylinder barrel. These tilting torques cannot be taken up by the pivotal support but tend to swing the cylinder barrel away from the valving surface. In addition, this type of prior art machine requires high precision of manufacture in order to make sure that, on one hand, the end face of the cylinder barrel sealingly engages the valving surface and, on the other hand, the cylinder barrel is supported exactly in the plane of the circular array of joint centers, where the resultant radial or lateral force acts. With the large forces involved a small offset of the support point relative to this plane results in rather large tilting torques.

It is an object of the invention to provide an axial piston type machine of the type initially defined, which guarantees, with rather low requirements as to the precision of manufacture of the elements involved, satisfactory taking-up of resultant radial or lateral forces of other torques and also safe and sealing engagement of the cylinder barrel with an abutment or valving surface on the casing or on a casing portion.

In accordance with the invention this object is achieved in an axial piston type machine of the type initially defined in that the cylinder barrel mediately or immediately journaled in said casing portion or said part associated to the casing, respectively, is rotatably supported in two places and an intermediate disc is located between said cylinder barrel and an abutment surface on said casing portion, said intermediate disc contacting said end face of said cylinder barrel adjacent said valving surface, on one side and said abutment surface, on the other side, with spherical contact surfaces curved about different centers of curvature, said abutment surface and said end face being shaped complementary to the respective contact surfaces of said intermediate disc.

In accordance with the invention, the cylinder barrel is supported, on one hand, in two places, while it is, on the other hand, mounted for axial movement in such a way as to maintain the engagement with the end face. By supporting the cylinder barrel in two places, all lateral forces and torques are absorbed by the casing or casing parts, in which the cylinder barrel is mounted. By making the cylinder barrel axially movable, the cylinder barrel will be urged towards the abutment surface on the casing or casing parts by the hydraulic forces acting in axial direction. The alignment problems occurring thereby are solved by means of the intermediate disc having different radii of curvature on both sides, of which one radius may be infinite because the intermediate disc is adapted to align itself in such a manner that there is compensation for misalignments of the other parts.

Advantageously the surface of intermediate disc that contacts the cylinder barrel is shaped to form said valving surface for alternatingly connecting said cylinder bores to high pressure and low pressure, respectively, and the disc is held against rotation relative to said casing portion by a retaining means. The retaining means can be an annular disc located in an annular groove in said casing portion, the annular groove surrounding said abutment surface on said casing portion. The annular disc has four peripheral recesses which are angularly spaced by 90°. There are a first pair of axial projections on said intermediate disc which engage a diametrically opposed pair of recesses on said annular disc. A second pair of projections which are on said casing portion engage the diametrically opposite pair of recesses angularly spaced by 90° relative to said first pair. Such retaining means hold the intermediate disc against rotation about the shaft axis but permit otherwise free angular and radial alignment of the intermediate disc with the abutment surface on the casing and with the cylinder barrel.

Preferably said recesses in the annular disc form pairs of parallel planar guide surfaces, between which said projections are guided with corresponding planar side surfaces in a manner to permit limited radial movement.

The intermediate disc is unsymmetrically loaded by hydraulic pressure. This pressure exerts a torque in the intermediate disc tending to tilt it. Compensation for this torque is provided by balancing pressure areas on the circumferential surface of said intermediate disc, said pressure areas communicating with the high and low pressure side, respectively, of the machine.

In one embodiment of the invention the center of curvature of the contact surface of said intermediate disc adjacent said cylinder barrel is in infinity. This arrangement allows short bores to form the conduits connecting the pressure areas to the high pressure and low pressure side of the machine, respectively.

Advantageously said cylinder barrel is mounted for axially sliding movement on the barrel shaft, which in turn is mounted in said casing portion on both sides of said cylinder barrel, said intermediate disc having an aperture through which said barrel shaft extends, there being a gap between said barrel shaft and the wall of said aperture to permit limited movement of said intermediate disc.

The invention is adapted to be used in similar ways and with the same advantage in different general types of axial piston type machines.

One possibility is that said stroke disc is affixed to or integral with a machine shaft mounted in a machine casing, the casing portion forming the barrel support being mounted for pivotal movement relative to said machine casing and stroke disc, and said axial pistons being linked to said stroke disc through piston rods, and further characterized in that said barrel shaft on one hand is pivoted about a fixed break point located on the axis of said machine shaft and on the other hand is supported, with its end projecting through said intermediate disc in said barrel support in a manner permitting axial and pivoting movement.

This has the result that the cylinder barrel is supported through the barrel shaft in two places, namely in the shaft pivot point and in the pivot center of the shaft bearing in the barrel support. Torques acting on the cylinder barrel are absorbed with a large lever arm. This type of mounting, however, avoids the danger of redundancy and compulsive forces. The longitudinal mobility and the intermediate disc guarantee both satisfactory contact beween intermediate disc and the end face of the cylinder barrel and satisfactory contact between the intermediate disc and the abutment surface on the casing portion, i.e., in this case the barrel support. Thereby both manufacturing tolerances and slight relative movements resulting from the kinematics of the pivoting movement are compensated for.

In an axial piston type machine of the invention the barrel support may be pivotable about an axis passing through the shaft pivot point. With this type of pivoting of the barrel support, there is, however, a constant, rather large dead volume in the cylinder bores. In order to avoid this dead volume, in prior art machines the barrel support is pivotable about an eccentric pivot axis, whereby in each pivot position a substantially negligible compression space in the cylinder bores is achieved in the top dead center position of the pistons.

In order to achieve these advantages with an axial piston type machine of the present kind while retaining the capability of the parts to align themselves relative to each other without compulsive forces, said barrel support is pivoted about an axis which is at a right angle to the plane containing machine and barrel axes and is spaced from said shaft pivot point, and which, at least approximately, intersects the angle bisector of the axes of sid machine shaft and said cylinder barrel, at maximum deflection of said barrel support. Advantageously the distance of said pivot axis from the shaft pivot point is equal to the radius of the circle determined by the pivotal points of said piston rods on said stroke disc. This makes it possible that in one of the pivotal end positions of said barrel support, the center of the spherical contact surface between said intermediate disc and said barrel support is located on the axis of said barrel support.

In axial piston type machines comprising a cylinder barrel mounted in a barrel support, and a stroke disc to which the pistons are positively linked, the cylinder barrel has to be driven by the rotation movement of the stroke disc. The centering of the cylinder barrel about a fixed pivot point located on the axis of the stroke disc, which is achieved with the construction of the invention, permits the cylinder barrel to be driven solely through the pistons and piston rods. Particularly large pivot angles with satisfactory drive connection between stroke disc and cylinder barrel can be achieved, in that said piston rods, at least if subjected to bending load, engage directly the walls of said cylinder bores guiding said pistons of said cylinder barrel, said cylinder barrel being driven by said stroke disc solely through said piston rods.

Preferably each piston rod has generally double-conical shape. A preferred embodiment of the invention is characterized in that each of said piston rods has a recessed portion in the area of the junction of the two cones forming the double-conical shape, there being hollow-conical end faces at each end of said recessed portion, and that a sleeve-shaped piston member is slidably guided in said cylinder bore and has spherical end faces, curved about a common center, in annular contact to said end faces of said recessed portion. A projecting narrow annular surface is formed on the bottom of said recessed portion, said sleeve-shaped piston member being supported on said annular surface midway between its end faces.

In a device of this type the double-cones of the piston rods transmit, in the kinematically effective angular ranges, the rotary movement to the cylinder barrel. By pivotably supporting the sleeve-shaped piston member on the spherical annular surface of the piston rod, the sleeve-shaped piston member guides the piston rod in its central position and transmits slideway pressures to the wall of the cylinder bore. By the abutment of the spherical end faces of the piston member on the end faces of said hollow conical recessed portions, the cylinder space is sealed.

The large pivot angles cause axial forces to be applied to the bearings of the machine shaft in excess of the capacity of roller bearings. Therefore axial bearings provided with hydrostatic balancing pressure areas are used in prior art machines. Such axial bearings, however, suffer from the disadvantage that they are very sensitive to contamination which tend to cause scoring in such bearings.

In accordance with one aspect of this invention an axial hydraulic balancing of the shaft bearings is used to avoid the aforementioned problems. To this end a ring having a spherical end face is mounted on the machine shaft and abuts a shoulder of said machine shaft. The center of curvature of said spherical end face is eccentric with respect to the machine shaft axis. There is also a support disc on the machine shaft. On one side, this disc has a correspondingly spherical end face accommodating said spherical end face of said ring for axially supporting said machine shaft and, on the other side, has a planar end face. Hydraulic balancing pressure areas are formed on both end faces of said support disc. The support disc engages a surface on said casing, which surface is slightly inclined with respect to the axis of the machine shaft.

Due to the small eccentricity of the rotation spherical surface, a slight movement of the support disc on the slightly inclined surface of the casing occurs. This causes friction of movement permitting slow free rotation of the support disc. Thus by the slow rotation of the disc, the abutment is continuously changed similar to the optical process of lapping spherical surfaces. The limiting diameters of the spherical and planar surfaces can be selected in such a manner that no zone remains free from this contacting process. While normally substantially circumferential rotation with slowly varying contact surfaces take place, the support disc can be caused to suddenly rotate at full speed, if there is a contact disturbing the normal running such as might be due to contamination or thermal influences. The sliding movements of the support disc are then also radial due to the inclined abutment, whereby the contamination is dissipated or the local overheating is reduced, the cause thereof being distributed over the whole bearing surface. Thereafter, the original slow rotation will be restored. The relapping process will be finished and the support disc is restored into its original state comprising an amorphous surface.

The invention can, however, be used advantageously in an axial piston type machine of another general type, wherein the cylinder barrel is rotatably mounted relative to a casing or reference member, and wherein the axial pistons slidingly engage a swash plate, which is pivoted in the casing or on the reference member. Preferably said cylinder barrel is supported for solely axial movement on said barrel shaft with the barrel shaft being mounted for rotation in said casing and means being provided for preventing rotational movement of said cylinder barrel relative to said barrel shaft.

In such a construction, a satisfactory mounting of the shaft can be achieved advantageously in that said cylinder barrel has exactly guiding bore portions at both of its ends, said barrel shaft being guided by said bore portions, said means for prevention of rotational movement comprising spline means on said barrel shaft and cylinder barrel between said bore portions.

In order to avoid one-sided mechanical and thermal loading of the pistons in the cylinder bore and to cause a slow rotational movement of the pistons, it is furthermore advantageous that shoes are articulated on said pistons by means of ball-and-socket joints and that said swash plate has a slightly convex surface on the side of said shoes. Thereby the shoe supported on the slightly convex-spherical surface has to execute a permanent small joint movement which results in a slow rotational movement of the pistons.

In order to hydraulically balance the shoes, on the one hand, and to avoid the risk of the shoes lifting off the swash plate on the low pressure side, provision can be made that each of the shoes has a sliding surface provided with a recess forming a central circular balancing pressure area, which recess communicates with the respective cylinder bore through connecting passages in said shoe and said piston; and that said shoes have edge portions and are held in contact with said swash plate by means of an apertured disc extending over said edge portions, said apertured disc having an axially positioned spherical bearing surface which rides on a convex-spherical surface of a spring biased pressing bearing, said convex-spherical surface being curved about the point of intersection of the barrel shaft axis and the plane defined by the centers of the balls of said ball-and-socket joints.

A further advantageous modification of the invention is characterized in that sliding surfaces of said shoes are planar, whereby the planar edge portions of said sliding surfaces and the spherical surface of said swash plate form wedge shaped gaps all around.

With such a construction of the shoes, there is a kind of "aquaplaning," i.e., the shoe is lifted hydrodynamically on the leading side of the respective direction of movement, so that it is easily movable. Thereby, the originally slightly underdimensioned hydraulic balancing pressure areas below the sliding surface of the shoe is increased by leaking oil under pressure, whereby it substantially balances the force exerted by the piston. On the trailing side of the respective direction of movement, the inner sealing area of the planar side surface around the recess is urged against the swash plate and is thus, at first, subjected to certain wear. Due to this wear, however, the effective area of the hydraulic balancing pressure area will be increased until eventually the pressure area completely balances the piston force and there will be no more wear.

DESCRIPTION OF SPECIFIC EMBODIMENTS

The following disclosure is offered for public dissemination in return for the grant of a patent. Although it is detailed to ensure adequacy and aid understanding, this is not intended to prejudice that purpose of a patent which is to cover each new inventive concept therein no matter how others may later disguise it by variations in form or additions or further improvements.

Figures 1, 2, 3:
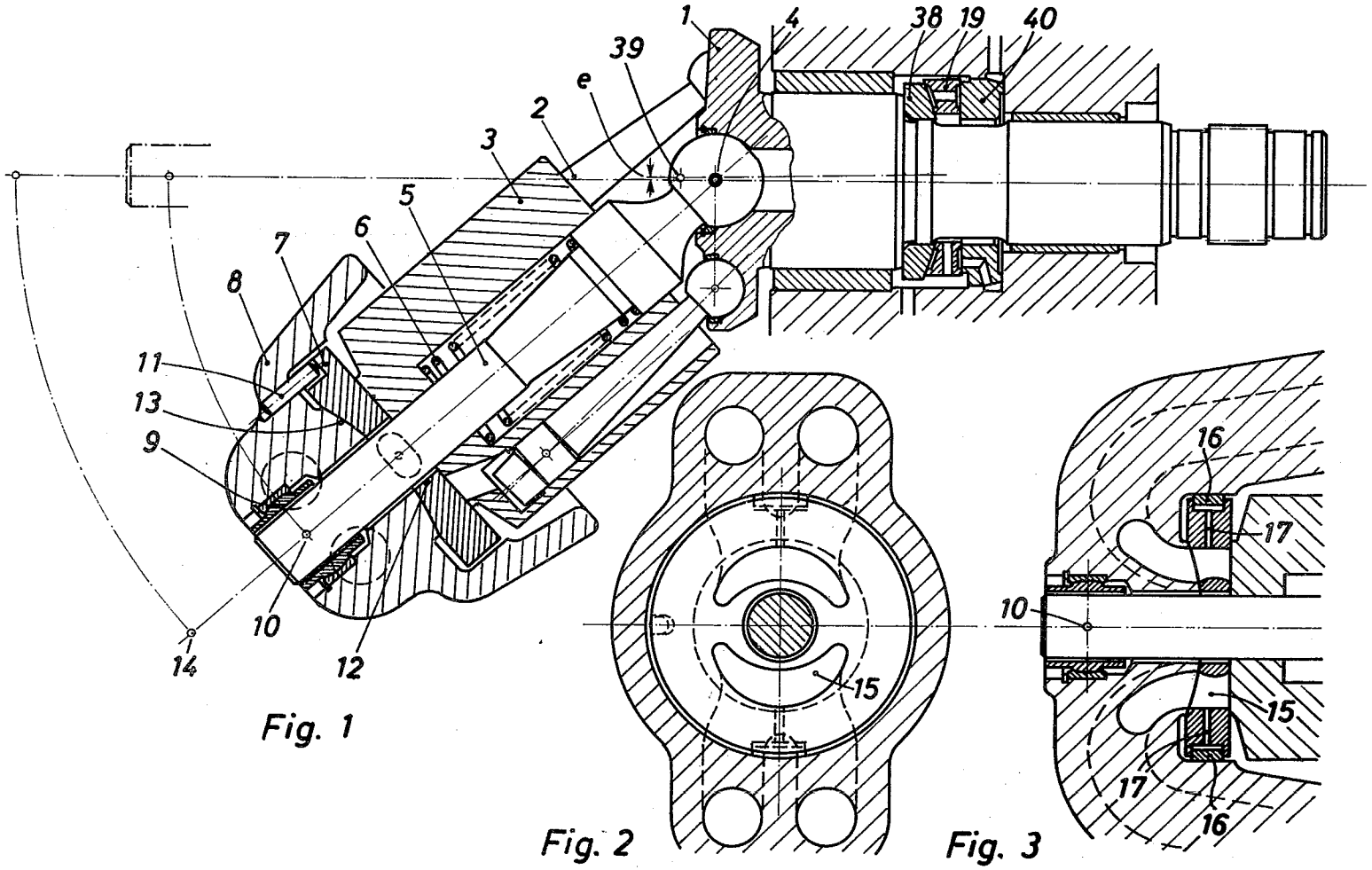
FIG. 1 is a longitudinal section of an axial piston type machine in accordance with the invention and pivoted to a pivot angle of 42°.
FIG. 2 is a section through the embodiment of FIG. 1 and shows a detail of the valving means and of the hydraulic balancing of the intermediate disc.
FIG. 3 is a sectional view of the arrangement of FIG. 2.

In FIG. 1 there is an axial piston machine having a drive flange (stroke disc) 1. Piston rods 2 are connected to the drive flange 1 on a circle (stroke circle). A cylinder barrel 3 is guided in axially movable manner on a barrel shaft 5. The barrel shaft 5 is articulated on the drive flange 1 about a point 4. A spherical surface 13 is provided on a barrel support 8, said spherical surface 13 being curved about a point 14. This surface 13 is an abutment surface on the barrel support. An intermediate disc 7 engages the spherical surface 13 with a corresponding bi-spherical surface. The intermediate disc 7 is provided with a planar end face adjacent the cylinder barrel, this end face forming a valving surface. The intermediate disc 7 is held against rotation relative to the barrel support 8 by a pin 11 which engages a peripheral recess of the intermediate disc 7. The end face of the cylinder barrel 3 is pressed against the planar end face of the intermediate disc 7 by a compression spring 6.

The barrel shaft 5 extends through a central aperture 12 of the intermediate disc 7, there being a gap between the barrel shaft 5 and the walls of the disc 7 defining the aperture 12. The barrel shaft 5 is mounted in a bearing 9 in the barrel support 8. This is done in such a manner that, on one hand, an axial movement of the barrel shaft 5 in the bearing 9 is possible and, on the other hand, a pivotal movement about a point 10 is permitted.

Passages 15 are provided in disc 7 for the oil to pass to and from the cylinders. Due to these passages, the intermediate disc 7 is relieved from axial hydraulic forces. Due to the spherical shape of the contact surface 13, there are, however, also radial forces. The radial forces are balanced by hydraulic balancing pressure areas 16, which communicate with the passage 15 through bores 17. Thus there is a complete hydraulic balancing of the hydraulic forces acting on the intermediate disc 7, whereby the latter is movable for the alignment movement.

In the axial piston type machine shown in FIGS. 1 to 3 the barrel support 8 pivots about an axis at a right angle to the plane of the paper in FIG. 1 and passing through the pivot point 4. The various elements permitting an alignment movement have the function of compensating for errors due to manufacture and assembly.

Figure 4:
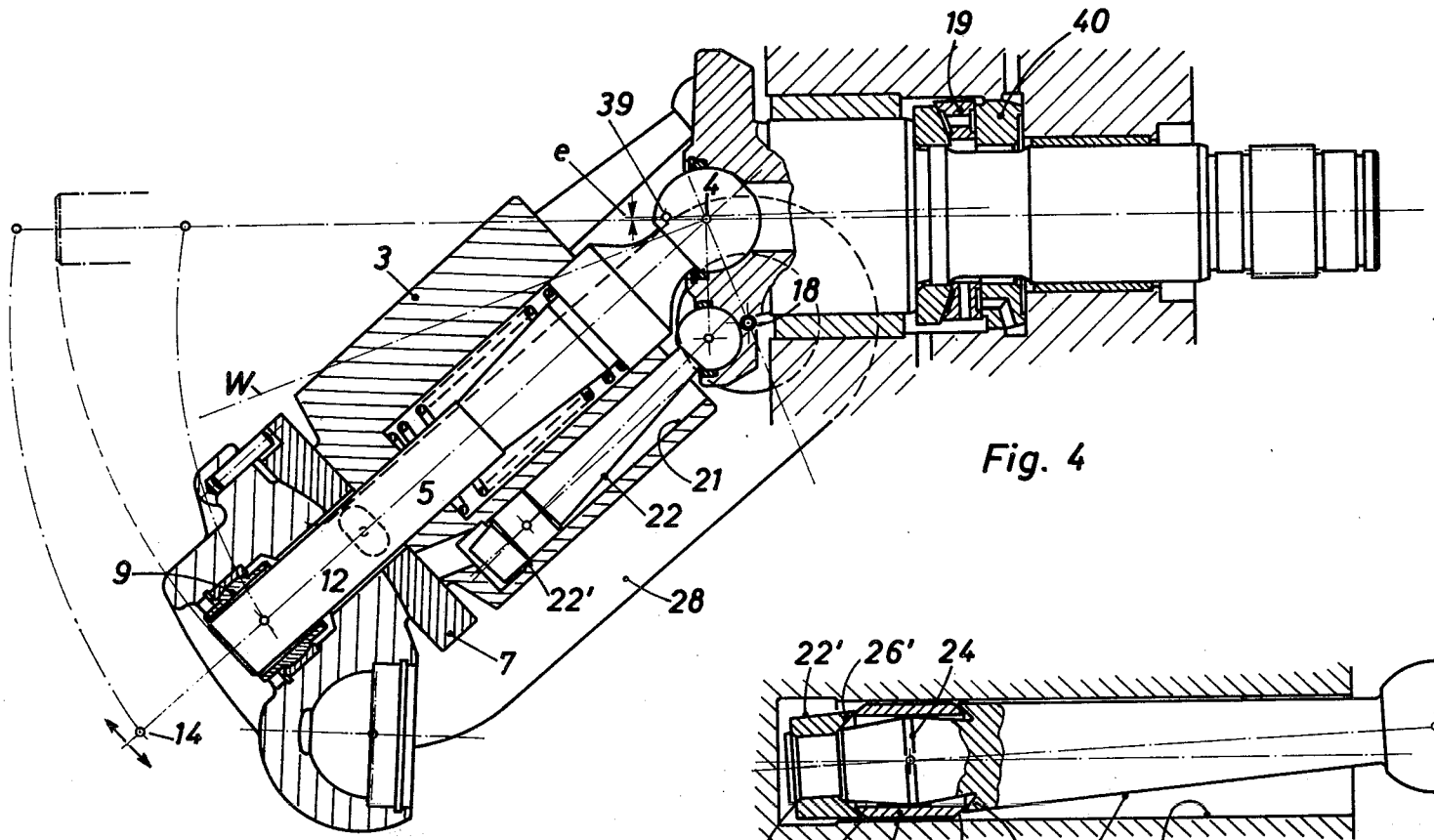
FIG. 4 is a longitudinal section of a second embodiment and shows an axial piston type machine wherein the barrel support is pivoted about an off-center axis.
Figure 5:
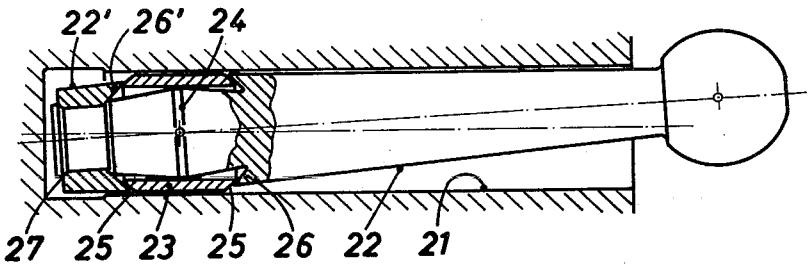
FIG. 5 is a fragmentary section through a cylinder block and shows a detail of the design of the piston with the associated piston rod in the cylinder bore.

FIG. 4, in contrast thereto, shows an axial piston type machine in which the cylinder barrel 3 pivots about an offcenter pivot axis 18. The pivot axis 18 is at a right angle to the plane of the paper in FIG. 4, thus at a right angle to the plane defined by the axes of the drive shaft and of the barrel shaft 5. The pivot axis 18 is located to substantially intersect the angle bisector between drive shaft axis and axis of barrel shaft 5 at maximum pivot position of the barrel support 28 (or a line normal to the angle bisector W, if the angle bisector relates to the actue angle between the axes). The distance of the pivot axis 18 from the pivot point 4 is preferably substantially equal to the radius of the stroke circle, i.e., the circle on the drive flange 1 on which the ball joints of piston rods 22 are located. By this position of the pivot axis 18 the pistons 23 have, in all pivot positions, the same top dead center position which can be selected to provide a minimum dead space in the cylinder bore 21. Furthermore provision is made thereby that the adjustment of the intermediate disc relative to the cylinder barrel 3 requires only small, uncritical alignment movements 20 (FIG. 6) about the point 14 of the barrel support 28. The aperture 12 permits sufficient play for the barrel shaft 5. As can be seen from FIG. 4, the barrel shaft 5 moves in the bearing 9 through half the distance through which the piston stroke is variable during the pivoting movement.

The piston rod has a double-conical shape comprising truncated cones 22 and 22'. It is located in the cylinder bore 21 the wall of which it contacts with the double cone 22, 22' in order to drive the cylinder barrel. The sphere on the right end of the barrel shaft 5 secures the pivot point 4 for the kinematic process of driving the cylinder barrel 3. A sleeve-shaped piston member 23 is supported on a spherical annular surface 24 which permits a pivotal movement of the piston member 23 relative to the piston rod 2.

The end faces of the sleeve-shaped piston member 23 are spherical surfaces which are curved about a common center. These spherical end faces 25 are held between hollow-conical end faces 26, 26' of a recessed portion of the piston rod 2. The hollowconical end face 26' is provided on the cone 22'. Cone 22 is held on the piston rod by a flange 27 in such manner, that the piston member 23 is easily movable.

The contact between the conical end faces and the spherical end faces form the inner sealing zone of the piston 23 which, with correct dimensioning of the construction, has a minimum annular space defined by the pressure surfaces. This contact is only slightly loaded in axial direction, while the main axial force is transmitted directly through the piston rod 2.

Figure 6:
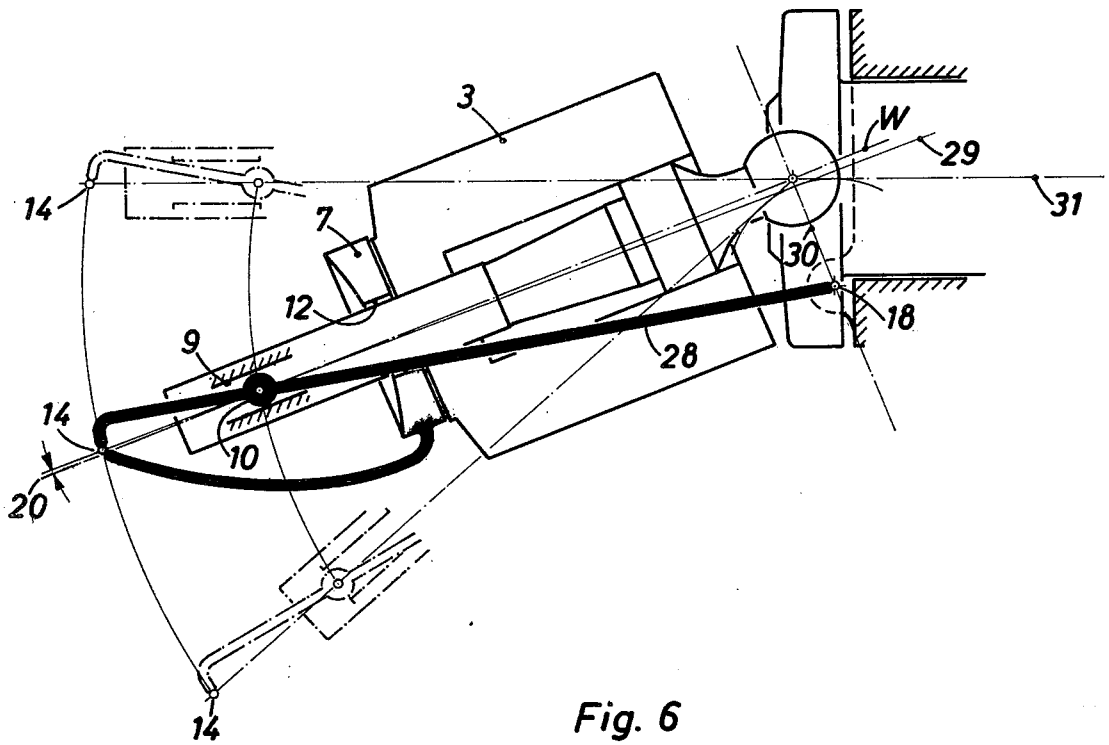
FIG. 6 is a schematic illustration of the embodiment of FIG. 4 and shows the pivoting kinematics.

The schematic representation of FIG. 6 shows how the off-center barrel support 18 supports the barrel shaft 5 through the pivotal bearing 9 at its center 10. The barrel shaft 5 slides in the bearing 9 during movement of the barrel support 28 without affecting the drive connection of the piston rods. The barrel support is guided by the pivot point 4. The barrel support 28 executes a pivotal movement relative to the barrel shaft 5. This movement is such that a fixed line 29 with respect to the barrel support passes in the zero position of the barrel support 28 through the pivot point 4 and is aligned with the axis 31 of the drive flange. At maximum pivot position this line 29 passes again through the pivot point 4. During the intermediate pivoting movement, the center 14 of the spherical surface 13 carries out a small movement which results in a correcting movement of the intermediate disc. This movement is permitted by the play of the barrel shaft 5 in the aperture 12.

Figures 7, 8, 9:
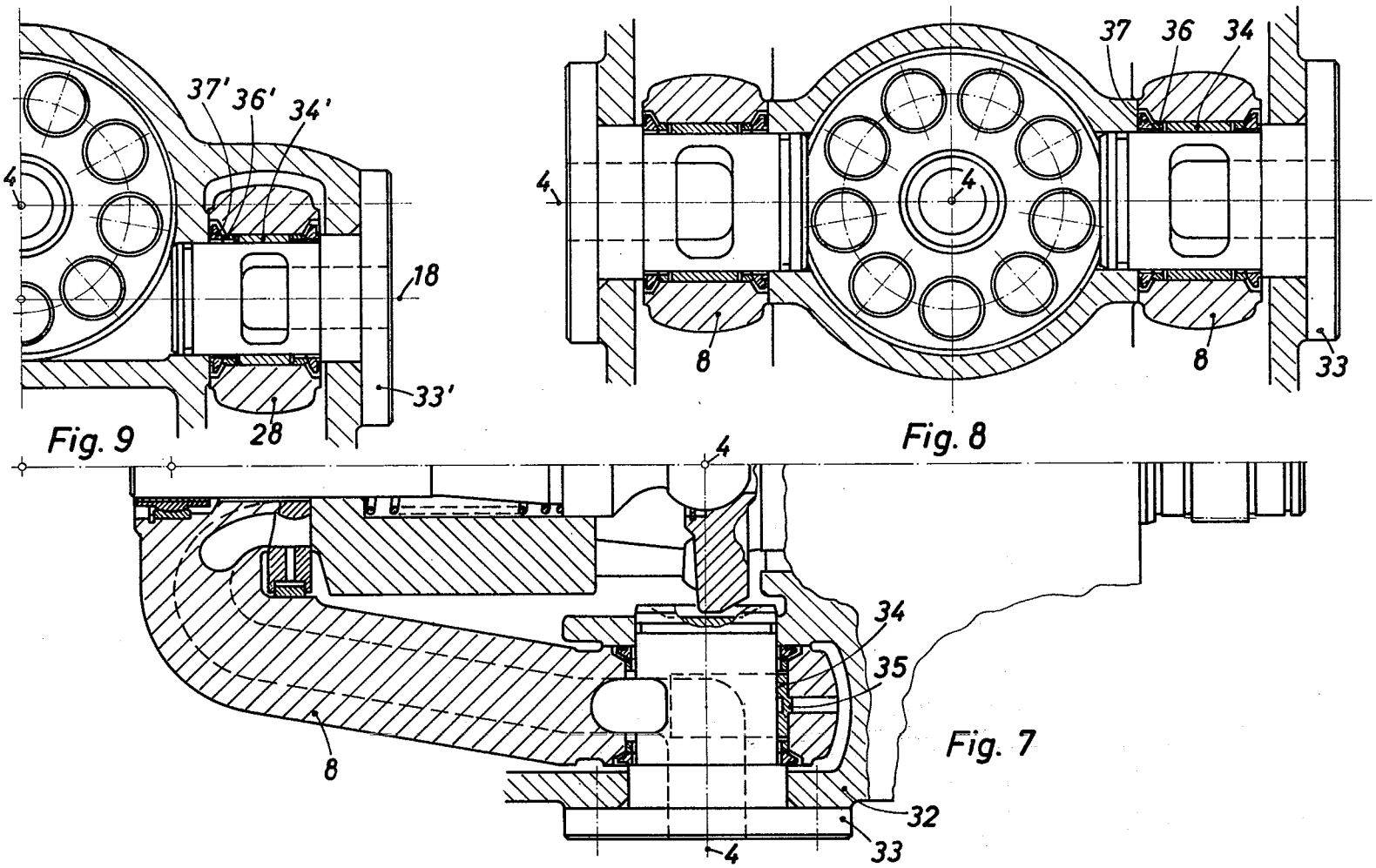
FIG. 7 is a fragmentary elevational view, partially broken away, of the embodiment of FIG. 4 and shows a detail of the pivotal mounting of the barrel support.
FIG. 8 is a transverse cross sectional view of the pivotal mounting in which the pivot axis passes, in accordance with FIG. 1, through the break point.
FIG. 9 is a partial transverse section showing an off-center pivot axis in accordance with FIG. 4.
Figure 10:
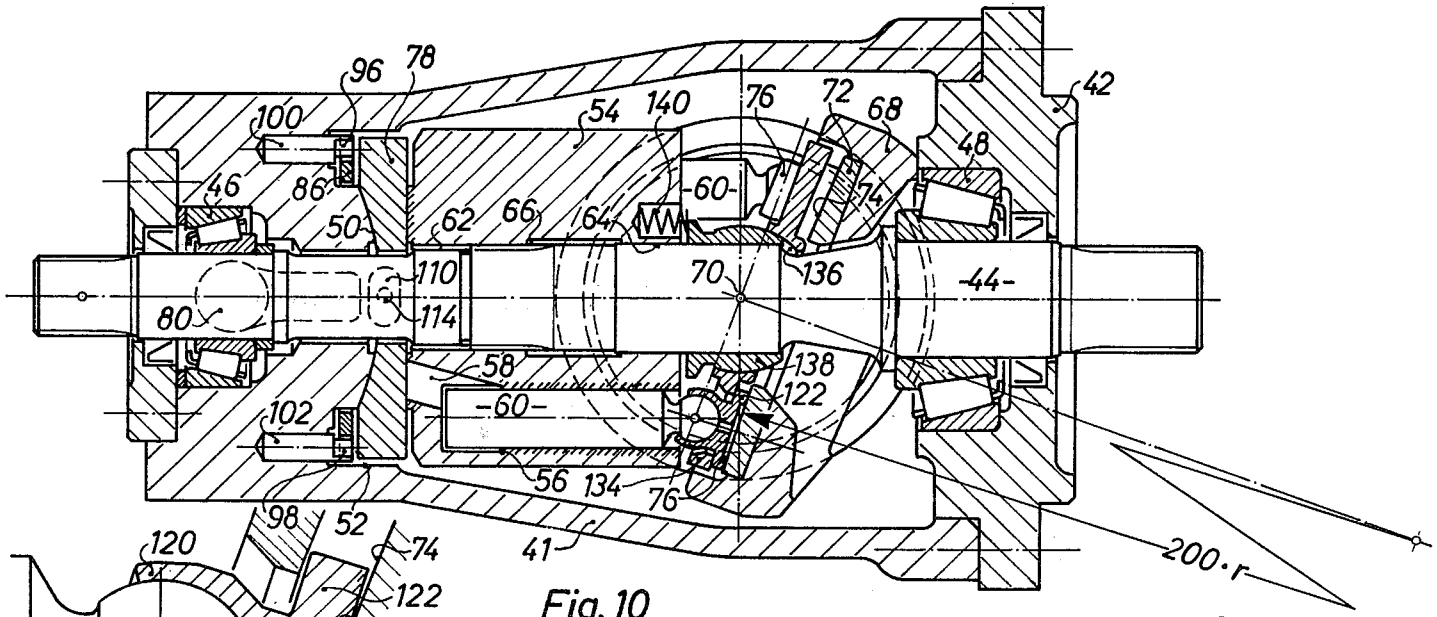
FIG. 10 is a longitudinal sectional view of an axial piston type machine having a pivotable swash plate.
Figure 13:
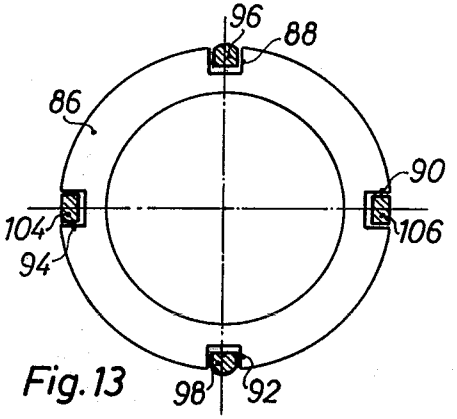
FIG. 13 illustrates the retaining of the intermediate disc in the casing.
Figure 12:
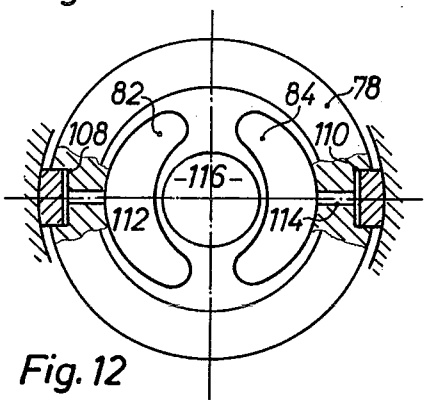
FIG. 12 shows the valve plate used in the embodiment of FIG. 10.
Figure 11:
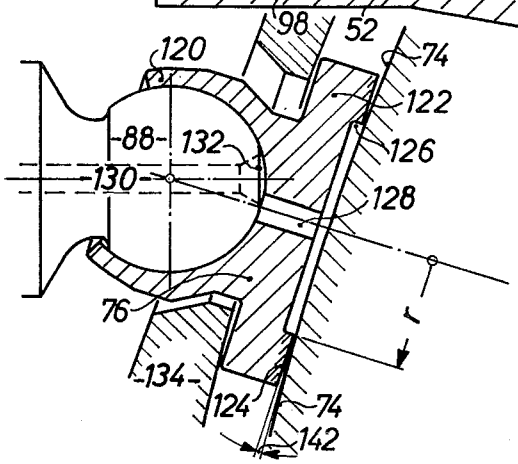
FIG. 11 shows in enlarged scale the shoe in contact with a convex swash plate.

FIGS. 7, 8 and 9 show the mode of supporting the barrel support 8 or 28, respectively. The barrel support conducts oil, as conventional with this type of machine, and is held by a bifurcated casing portion with a bearing 33 or 33', respectively, therebetween. The bearings 34 or 34', which are prevented from rotation by pin 35, are provided with plastic coatings. In the outside fit of the bearing boxes, there are sealing steel sleeves 36, 36'. Having play with respect to the bearings 33, 33' they engage conical disc 37, 37' axially through a cone-cone-surface contact, whereby an axial seal is achieved. This is a simple pivot mounting, which is independent of the tolerances of a bearing box having a plastic layer.

FIGS. 1 and 4 show an axial bearing support disc 19 of which supports a ring 38 on the shaft. This ring has a spherical end face. The center 39 of the spherical end face is slightly eccentric with respect to the shaft axis 31. The eccentricity e (FIG. 4) causes a vibrating movement of the support disc 19 on a planar surface 40 which is slightly inclined with respect to the shaft axis, there being a slow rotation of the support disc 19. The spherical surfaces of the two bodies 19 and 38 are dimensioned in such a way as to being slightly pushed apart under the action of a strong oil flow and transmit the thrust through a supporting oil film. In order to prevent scoring on the bearing surfaces due to contamination or deformation, the described provisions are made, whereby any wear caused by microscopic particles in the oil is distributed over the whole bearing surface by means of the relative dimensioning of the diameters, the spherical shape being maintained.

In the embodiment of FIGS. 10 to 13, there is a machine casing 41 having an internal chamber which is closed by a cover 42. A shaft 44 is mounted in bearings 46 and 48 in the machine casing 41 and in the cover 42, respectively. The machine casing 41 has a spherical abutment surface 50. Around this spherical abutment surface there is a groove 52. A cylinder barrel 54 having cylinder bores 56 is supported on shaft 44. The cylinder bores 56 communicate with passages 58, which open at the left end face (as viewed in FIG. 10) of the cylinder barrel. Axial pistons 60 are slidable in the cylinder bores 56. The cylinder barrel 54 is provided near both its ends with exactly guiding central bosses 62, 64, which fit closely to the shaft 44, whereby the cylinder barrel 54 is held exactly on the shaft. Intermediate the exactly guiding bosses 62 and 64 there is a spline connection 66 between shaft 44 and the cylinder barrel such that the cylinder barrel 54 is guided on the shaft 44 in an axially movable manner but is restrained against rotation relative to the shaft.

A swash plate support 68 is pivoted in casing 41 about an axis 70. The swash plate support 68 supports a swash plate or stroke disc 72, the left surface of which 74 (as viewed in FIG. 1) adjacent the cylinder barrel 54 is of slightly convexspherical shape. The pistons 60 engage the swash plate 72 through shoes 76. The left end face of the cylinder barrel 54 bears against an intermediate disc 78 which in turn bears against the spherical abutment surface 50.

Upon rotational movement of shaft 44 with cylinder barrel 54, the axial pistons 60 are caused to reciprocate in the cylinder bores 56 in well-known manner. By valving means at the left of the barrel 54, the cylinder bores 56 are alternatingly connected to a high pressure or a low pressure connection 80 through passages 58, whereby, with pump operation, oil is sucked in through the low pressure connection and is discharged through the high pressure connection.

The shaft 44 and the guiding by means of bosses 62 and 64 cause the orientation of the cylinder barrel 54 to be fixed with respect to the casing. There is no means for the left end face of cylinder barrel 54 to align itself with the abutment surface 50 on the casing. It is not possible to make sure by mere precision of manufacture that the cylinder barrel 54 with its given orientation presses against the abutment surface 50 in a sealing manner. Therefore, an intermediate disc 78 is provided. This intermediate disc has on its two end faces spherical surfaces, the radius of curvature of the left surface in FIG. 1 being equal to the radius of curvature of the abutment surface 50 and the radius of curvature of the right surface in FIG. 1 being equal to the radius of curvature of the end face of the cylinder barrel. In the embodiment shown, the latter radius of curvature is infinite, i.e., the right end face of the intermediate disc 78 and the left end face of the cylinder barrel 54 are planar. However, there may also be a finite curvature of these two surfaces, provided the radii of curvature of the left and of the right end face of the intermediate disc 78 and thus of the abutment surface 50 and the end face of the cylinder barrel 54, respectively, are different. If the intermediate disc 78 is free with regard to its radial and tilting movements, differences in the orientation of the abutment surface 50 and of the cylinder barrel 54 are exactly compensated for by the intermediate disc 78.

The invention permits supporting the cylinder barrel 54 rigidly on the shaft 44, whereby all laterally acting forces on the cylinder barrel 54 are absorbed by the shaft 44 and thus by the casing 41. On the other hand, a safe and sealing engagement of the cylinder barrel 54 with its left end face on a valving means non-rotatable with respect to the casing is ensured.

The intermediate disc 78 is, as in the embodiment of FIGS. 1 to 9, formed as valving means and has a valving surface with two kidney-shaped control openings 82 and 84 which communicate with the high pressure and low pressure connections, respectively. For this purpose, the intermediate disc 78 is retained as to its position about the axis of shaft 44. This retaining is, however, effected in such a manner that an alignment of the intermediate disc 78 with both the abutment surface 50 and the end face of the cylinder barrel 54 will be possible. For this purpose an annular disc 86 is located in the annular groove 52. The annular disc 86 is provided with four recesses 88, 90, 92 and 94 which are spaced by 90° apart. See FIG. 13. A pair of projections 96, 98 engage two (i.e., 88 and 92) of the diametrically opposite recesses. These projections are mounted on pins 100, 102 secured to the casing 41. A pair of diametrically opposed projections 104, 106 is provided on the intermediate disc 78. These projections engage the diametrically opposite recesses 94 and 90, respectively. Each of the recesses 88 to 94 has a pair of planar side faces in which the projections 96, 98 and 104, 106, respectively, are exactly guided; however, a limited radial movement of the projections in the recesses is permitted. By this arrangement, the angular position of the intermediate disc 78 about the axis of the shaft 44 is exactly fixed, an aligning movement including a limited radial movement being permitted however.

Thus the intermediate disc 78 has the function of the valving means. It is positioned by oil pressure on one side. Thereby a torque is exerted on the intermediate disc 78 which tends to tilt the latter. In order to counteract this torque, hydraulic balancing pressure areas 108, 110 are provided on the periphery of the intermediate disc 78. These pressure areas communicate through channels 112, 114 with the control openings 82 and 84, respectively. The intermediate disc 78 has a central aperture 116, through which shaft 44 extends at a distance from the walls defining the aperture. Thereby the shaft 44 does not interfere with the alignment movement of the intermediate disc 78.

The pistons 60 bear against the swash plate through ball joints formed by balls 118 on the ends of the pistons and shoes 76. These balls are held in sockets 120 of the shoes. The shoes have peripheral flanges 122 extending beyond the sockets 120. These flanges have a planar side surface 124. There is a central recess 126 in the planar slide surface 124. The diameter of this recess is substantially equal to the diameter of the cylinder bore 56. This recess 126 is connected with the cylinder bore 56 through passages 128 and 130, so that a hydraulic balancing pressure field is formed in the recess, which balances the hydraulic force acting through piston 60. A flat 132 on the end of the joint ball 118 provides (in conventional manner) communication between passages 128 and 130 with various pivot positions of the swash plate 72.

Due to the slightly convex-spherical surface 74 the inclination of the shoes 76 relative to the piston 60 is changed continuously. Thus an additional slow rotatory movement of the pistons 60 within the respective cylinder bore results.

An apertured disc 134 extending over these edge portions 122 of the shoes urges the shoes 76 into engagement with the swash plate 72. The apertured disc 134 has a concave-spherical bearing surface 136 which fits about a convex-spherical surface of a bearing 138. This convex-spherical surface is curved about the point of intersection of the shaft axis through the plane defined by the centers of the joint balls 118. The bearing 138 is slidable on shaft 44 and is biased by springs 140. Thereby the shoes 76 are held in positive engagement with the surface 74 of the swash plate 72 on the low pressure side also.

The centers of the joint balls 118 follow an elliptical course on the slightly spherical surface 74 of the inclined swash plate 72. Also, the holes of the apertured disc 134 are sufficiently large to permit the flanges 122 of the shoes to follow this course. The intersection point of the axis of the shaft 44 through the plane defined by the centers of the joint balls 118 thus centers the apertured disc 134, the disc having a concave abutment surface curved corresponding to the radius of surface 74 for engagement on the flange-shaped edge portions 122.

The ratio of the radius of curvature of surface 74 of swash plate 72 to the radius of the hydraulic balancing pressure field 126 is above 200 : 1. The surface 74 of the swash plate 72 is, therefore, only slightly curved, so that a wedge-shaped gap 142 exists between the planar portions of the slide surface 124 and the surface 74.

In the embodiment of FIGS. 10 to 13 the swash plate 72 is pivotable about an axis 70 passing through said intersection point and intersecting the axis of shaft 44. However, the system described would also permit a pivotal movement of the swash plate 72 about an axis with a certain parallel offset from axis 70 and therefore not intersecting said axis of shaft 44.

I claim:

1. In an axial piston machine comprising a casing having a portion about a primary axis with high and low pressure openings therein, a cylinder barrel journaled in the casing at two spaced points along its axis for axial and rotary motion about said primary axis with respect to the casing, said cylinder barrel having two ends with axial cylinder bores extending inwardly from one end and connecting passages extending from the cylinder bores to the other end, said other end being adjacent said portion, valving means for valving the flow of fluid to and from said cylinder bores, whereby with said rotation said passages communicate with said openings through said valving means, said valving means including said portion, said other end and an intermediate disc between the barrel and said portion of the casing, said disc having two sides with one side in contact with the casing and the other side in contact with said other end of the barrel, said sides having different centers of curvature, said other end of the barrel and said portion of the casing having shapes complementary to the respective side of the disc which they contact, and means for rendering said disc stationary with respect to said casing, a stroke plate positioned adjacent said one end of the cylinder barrel, said stroke plate having an axis which is at an angle to the primary axis, and axial piston means having portions within said cylinder bores and portions contacting said stroke plate to produce a reciprocating movement thereof upon relative rotational movement between the cylinder barrel and the stroke plate, the improvement comprising:

said means for rendering said disc stationary including a retainer member, first guide means engaging said casing and said retainer member for guiding said retainer member relative to said casing in a first direction normal to said primary axis, second guide means engaging said retainer member and said intermediate disc for guiding said intermediate disc relative to said retainer member in a second direction normal to said first direction, said first and second guide means permitting movement of the intermediate disc in the direction of said primary axis and angular movements about axes parallel to said first and second directions.

2. In a machine as set forth in claim 1, wherein said casing defines an annular groove about said portion, said retainer member being an annular disc having a periphery, said disc having a first pair of diametrically opposed recesses in the periphery thereof and second pair of diametrically opposed recesses in the periphery thereof and spaced ninety degrees from said first pair of recesses, a first pair of opposed projections extending from said casing into said first pair of recesses, and a second pair of diametrically opposed projections extending from said casing into said second pair of recesses, said first pair of recesses and said first pair of projections forming said first guide means, said second pair of recesses and said second pair of projections forming said second guide means.

3. In a machine as set forth in claim 2, wherein said annular disc at each of said recesses forms pairs of parallel planar guide surfaces, each projection having corresponding planar side surfaces in juxtaposition to said guide surfaces of the respective recess, said recesses and said projections being positioned and proportioned to permit limited radial movement of the projections in the recesses.

4. In an axial piston machine comprising a casing having a portion about a primary axis with high and low pressure openings therein, a cylinder barrel journaled in the casing for axial and rotary motion about said primary axis with respect to the casing, said cylinder barrel having two ends with axial cylinder bores extending inwardly from one end and connecting passages extending from the cylinder bores to the other end, said other end being adjacent said portion, valving means including said portion and said other end for valving the flow of fluid to and from said cylinders whereby with said rotation said passages communicate with said openings through said valving means, a swash plate positioned adjacent said one end of the cylinder barrel at an angle to the primary axis, and axial piston means having portions within said cylinder bores and shoes slidingly engaging a face of said swash plate to produce a reciprocating movement thereof upon rotational movement of said cylinder barrel, each shoe having a planar surface in contact with said face and a central recess in said surface and forming a balancing pressure area, the respective axial piston means having a passage extending from said pressure area to the interior of the respective cylinder bore, the improvement comprising:

said face of the swash plate being slightly convex whereby the flat shoes in contact with said slightly convex face results in the inclination of the shoes relative to the piston being constantly changed and the shoes are supported dynamically by a kind of "aquaplaning" effect.

5. In a machine as set forth in claim 4, wherein each piston means includes a ball and socket joint at the respective shoe, said joints having centers positioned in a plane intersecting the primary axis at a point, each shoe has a flange, the swash plate includes an apertured disc with the shoes extending through the apertures thereof with the apertured disc bearing against the flanges, bearing means forming a convex bearing surface on said shaft and movable axially on the shaft, said apertured disc defines a central concave-spherical bearing surface positioned on said convex bearing surface, said concave-spherical bearing surface being curved about the point of intersection of the primary axis and said plane, and means engaging said bearing means and resiliently urging said apertured disc away from said barrel.

* * * * *